US012016460B1

(12) United States Patent
Whitt

(10) Patent No.: US 12,016,460 B1
(45) Date of Patent: Jun. 25, 2024

(54) CORNER SHELF SECUREMENT SYSTEM

(71) Applicant: Steven Whitt, Colorado Springs, CO (US)

(72) Inventor: Steven Whitt, Colorado Springs, CO (US)

( * ) Notice: Subject to any disclaimer, the term of this patent is extended or adjusted under 35 U.S.C. 154(b) by 0 days.

(21) Appl. No.: 18/199,762

(22) Filed: May 19, 2023

(51) Int. Cl.
*A47B 96/02* (2006.01)
*A47K 10/32* (2006.01)
*A47K 10/38* (2006.01)

(52) U.S. Cl.
CPC ..... *A47B 96/022* (2013.01); *A47K 10/32* (2013.01); *A47K 2010/389* (2013.01)

(58) Field of Classification Search
CPC . A47B 96/022; A47K 10/32; A47K 2010/389
See application file for complete search history.

(56) References Cited

U.S. PATENT DOCUMENTS 2,472,004 A * 5/1949 Czerniewicz ..... A47B 96/022 108/42
D175,229 S * 7/1955 Neufeld ..... D25/102
D313,720 S 1/1991 Sorenson
5,992,654 A 11/1999 Dente, Jr.
6,059,128 A 5/2000 Wang
D451,743 S 12/2001 Henderson
7,621,223 B2 * 11/2009 Haghayegh ..... A47B 96/022 108/42
8,839,980 B2 * 9/2014 Baines ..... A47K 3/281 211/90.03
8,985,349 B2 3/2015 Stenhouse
9,402,476 B2 * 8/2016 Crandall ..... A47K 3/281
9,439,510 B2 9/2016 Karins, Sr.
D783,311 S * 4/2017 Williamson ..... D6/574
D907,397 S * 1/2021 Huang ..... D6/525
D926,491 S * 8/2021 Peng ..... D6/562
11,412,850 B2 * 8/2022 Sisto ..... A47B 95/008
2005/0040124 A1 * 2/2005 Fontana ..... A47B 96/022 211/90.01
2008/0224004 A1 * 9/2008 Gallien ..... A47B 96/066 248/220.1
2009/0090683 A1 * 4/2009 Haghayegh ..... F16B 12/04 211/90.01
2012/0168582 A1 * 7/2012 Kelly ..... A47B 96/022 248/206.5
2015/0216366 A1 * 8/2015 Knoll, Jr. ..... A47B 57/045 211/90.01
2017/0347811 A1 * 12/2017 Waid ..... A47B 96/024
2022/0160123 A1 * 5/2022 Scanlon ..... A47K 3/281

FOREIGN PATENT DOCUMENTS

CA 2709663 4/2009
JP 2020014781 A * 1/2020

* cited by examiner

*Primary Examiner* — Ko H Chan

(57) ABSTRACT

A corner shelf securement system for attaching to a pair of walls and forming to a corner joining the walls includes a pair of walls joined together to define a corner between the pair of walls. A board has a bend defining a first section being perpendicular to a second section such that the board is L-shaped. A shelf is coupled to the board, and a plurality of braces is coupled to the board and to the shelf. The plurality of braces support the shelf in a perpendicular position relative to the board. A fastener is mounted on the board and is engageable to the pair of walls such that the bend is positioned within the corner.

9 Claims, 10 Drawing Sheets

CORNER SHELF SECUREMENT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to corner shelves and more particularly pertains to a new corner shelf for attaching to a pair of walls and forming to a corner joining the walls.

(2) Description of Related Art Including Information Disclosed Under 37 CFR 1.97 and 1.98.

The prior art relates to corner shelves and includes a variety of corner shelves attaching to a pair of adjacent walls joined together at a corner. Known prior art does not include a corner shelf being L-shaped and being removably attached to the pair of adjacent walls such that a bend of the corner shelf is positioned within the corner of the pair of adjacent walls.

BRIEF SUMMARY OF THE INVENTION

An embodiment of the disclosure meets the needs presented above by generally comprising a pair of walls joined together to define a corner between the pair of walls. A board has a bend defining a first section being perpendicular to a second section such that the board is L-shaped. A shelf is coupled to the board, and a plurality of braces is coupled to the board and to the shelf. The plurality of braces support the shelf in a perpendicular position relative to the board. A fastener is mounted on the board and is engageable to the pair of walls such that the bend is positioned within the corner.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
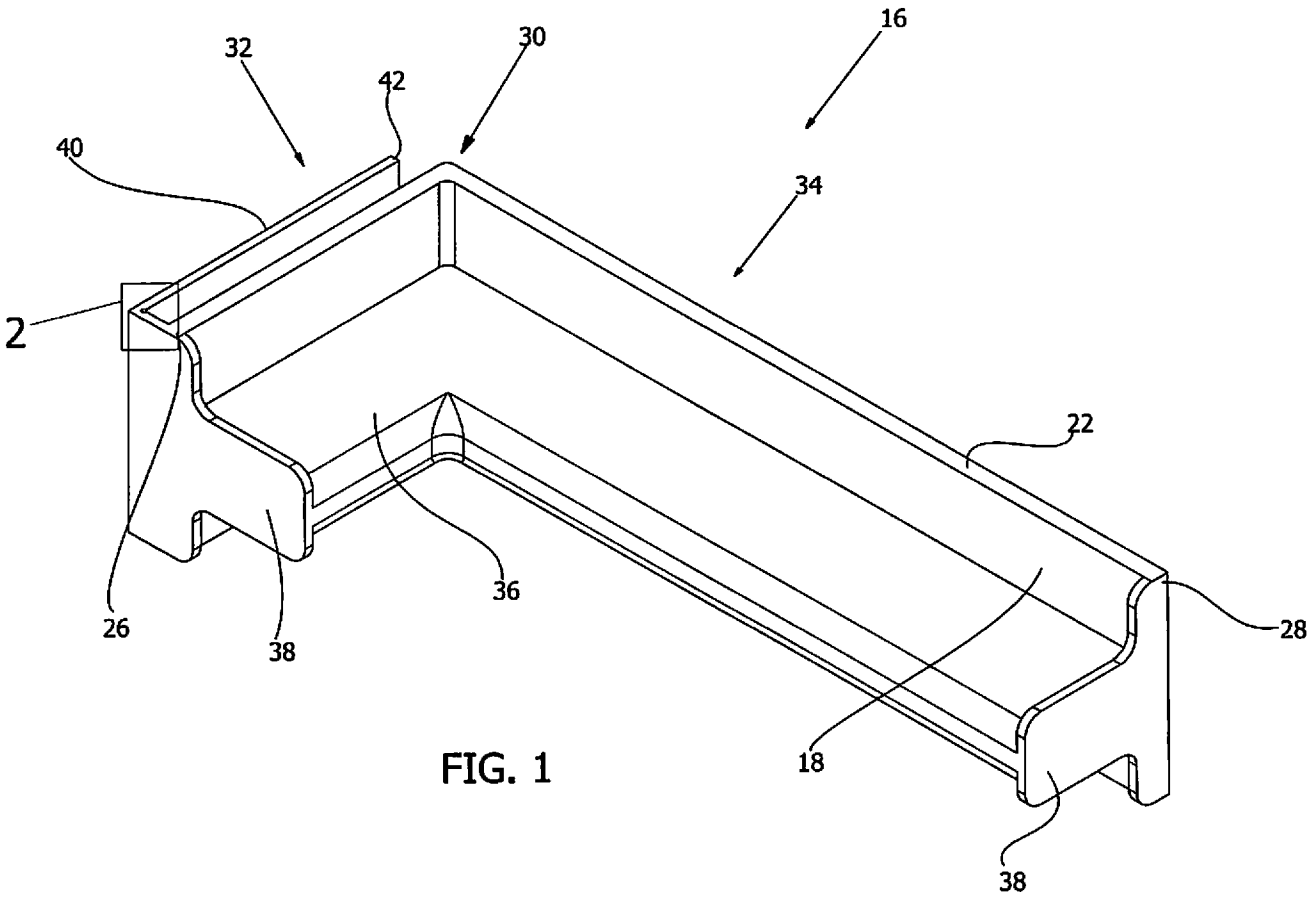
FIG. 1 is a front isometric view of a corner shelf securement system according to an embodiment of the disclosure.
Figure 2:
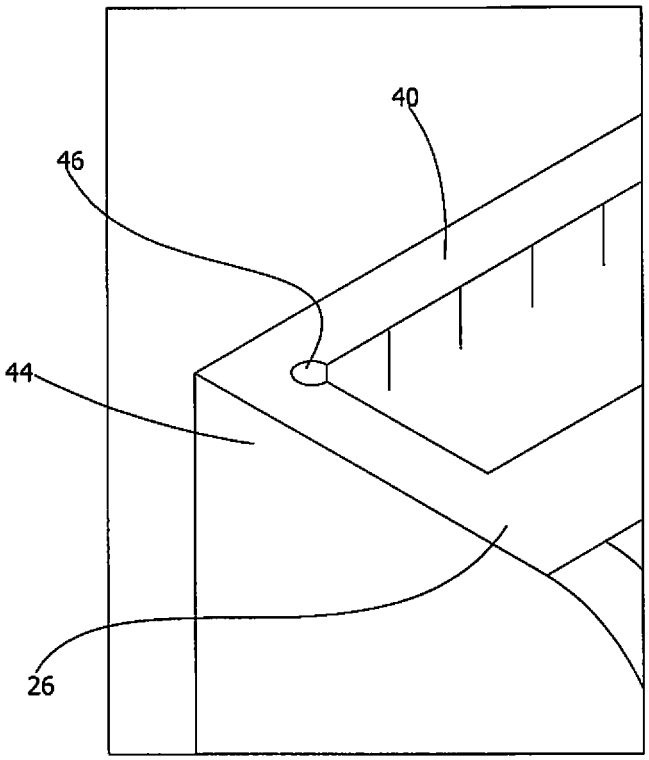
FIG. 2 is a detail view of an embodiment of the disclosure taken from area "2" of FIG. 1.
Figure 3:
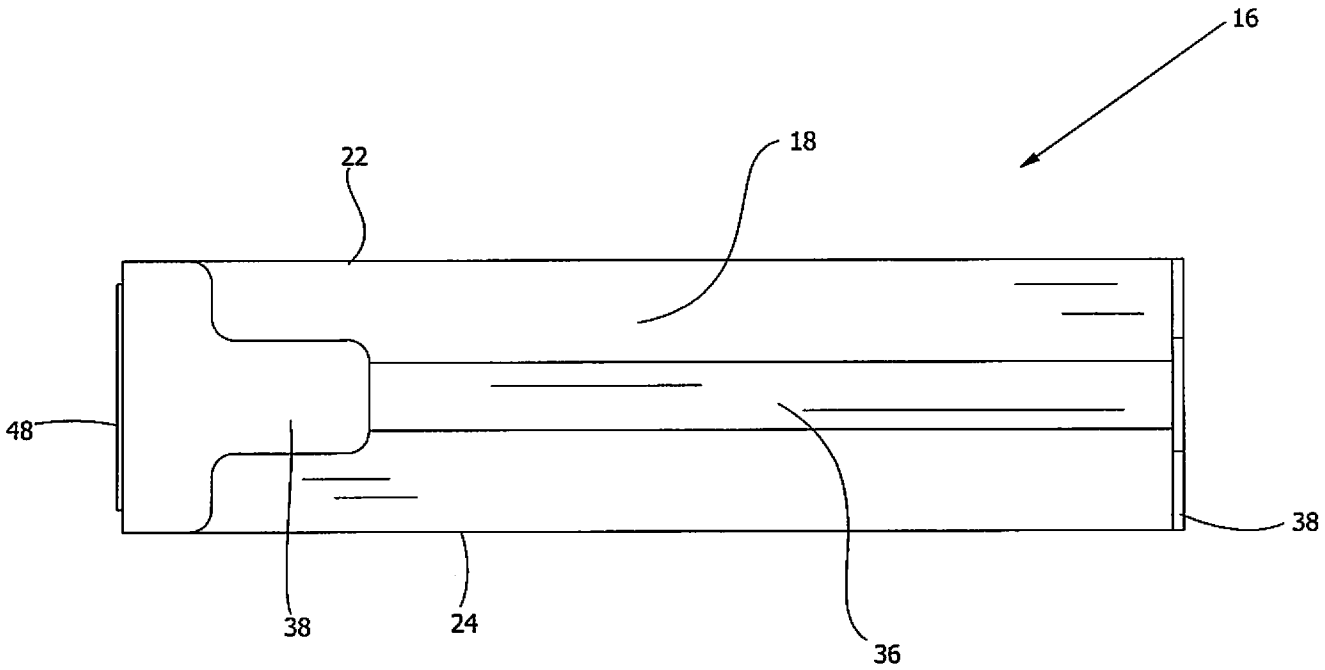
FIG. 3 is a front view of an embodiment of the disclosure.
Figure 4:
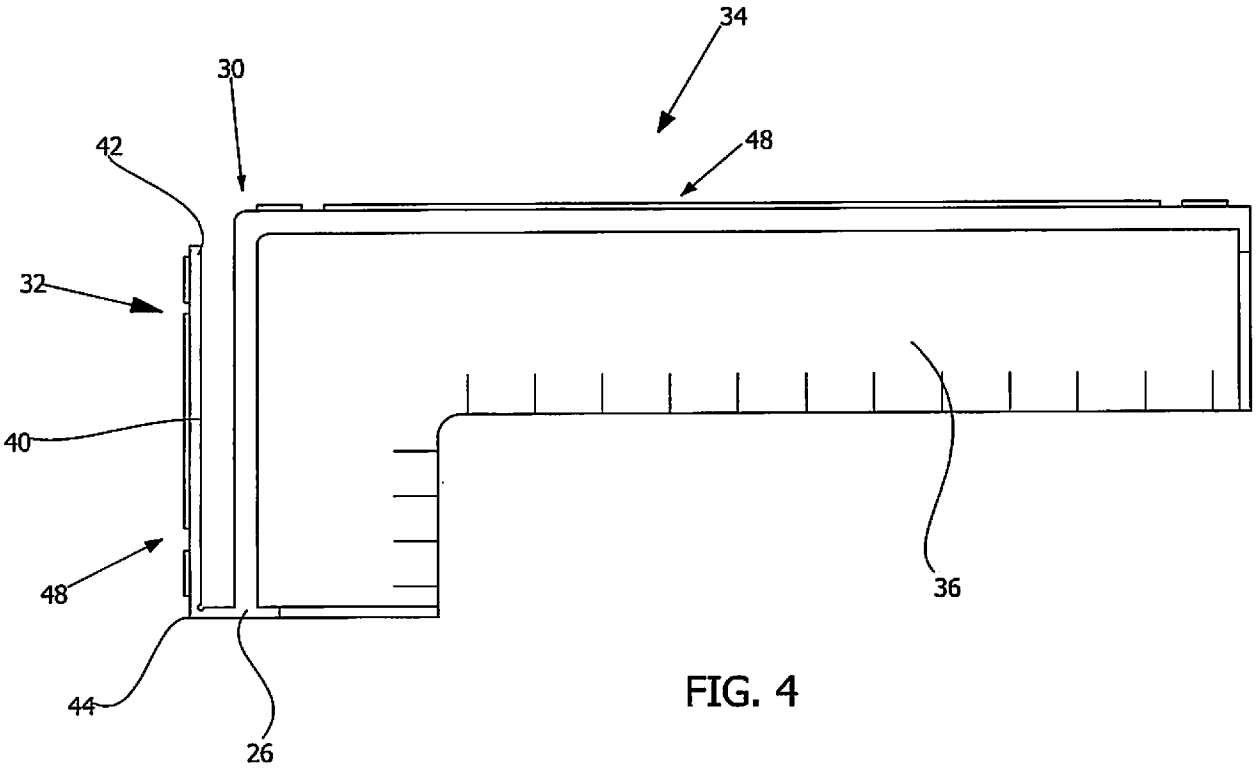
FIG. 4 is a top view of an embodiment of the disclosure.
Figure 5:
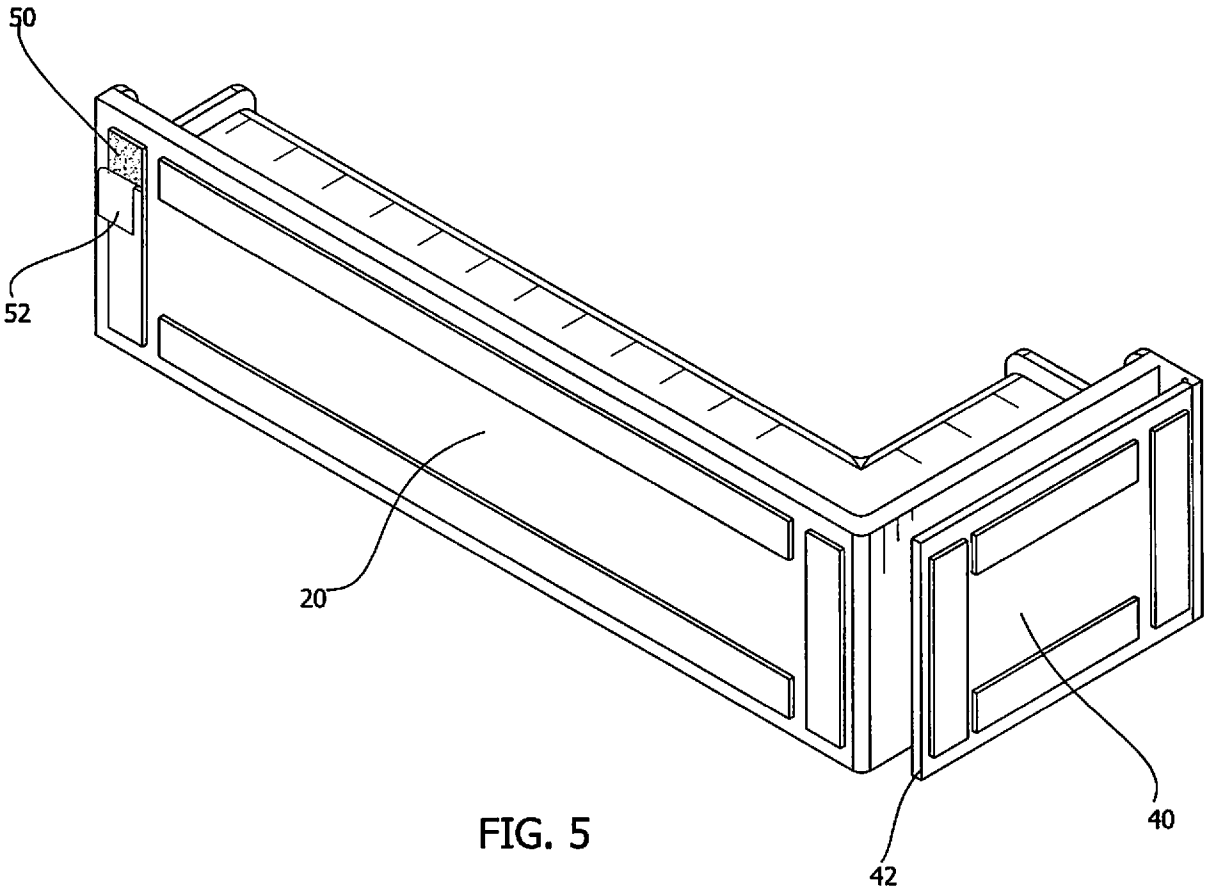
FIG. 5 is a rear isometric view of an embodiment of the disclosure.
Figure 6:
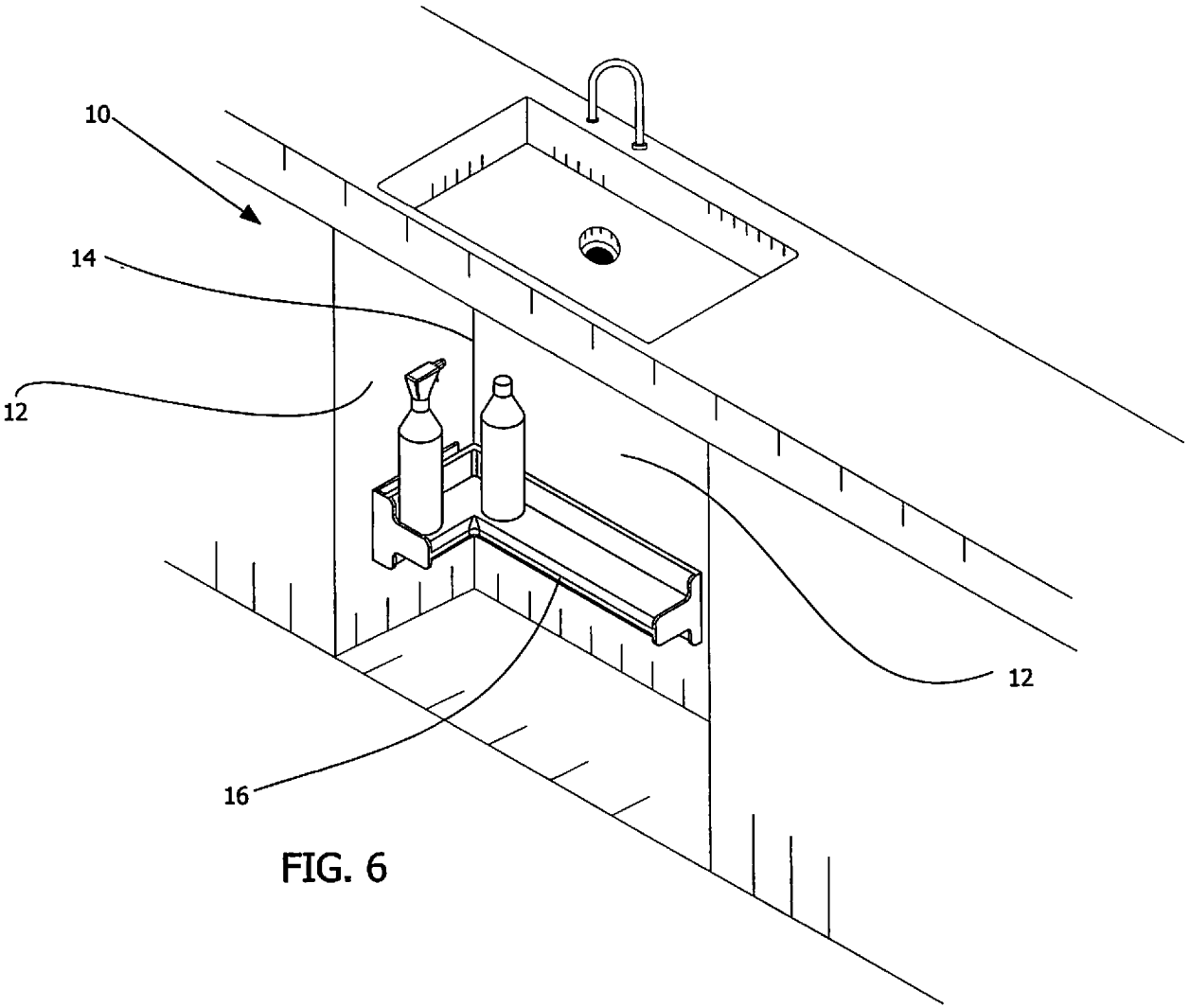
FIG. 6 is an isometric in-use view of an embodiment of the disclosure.
Figure 7:
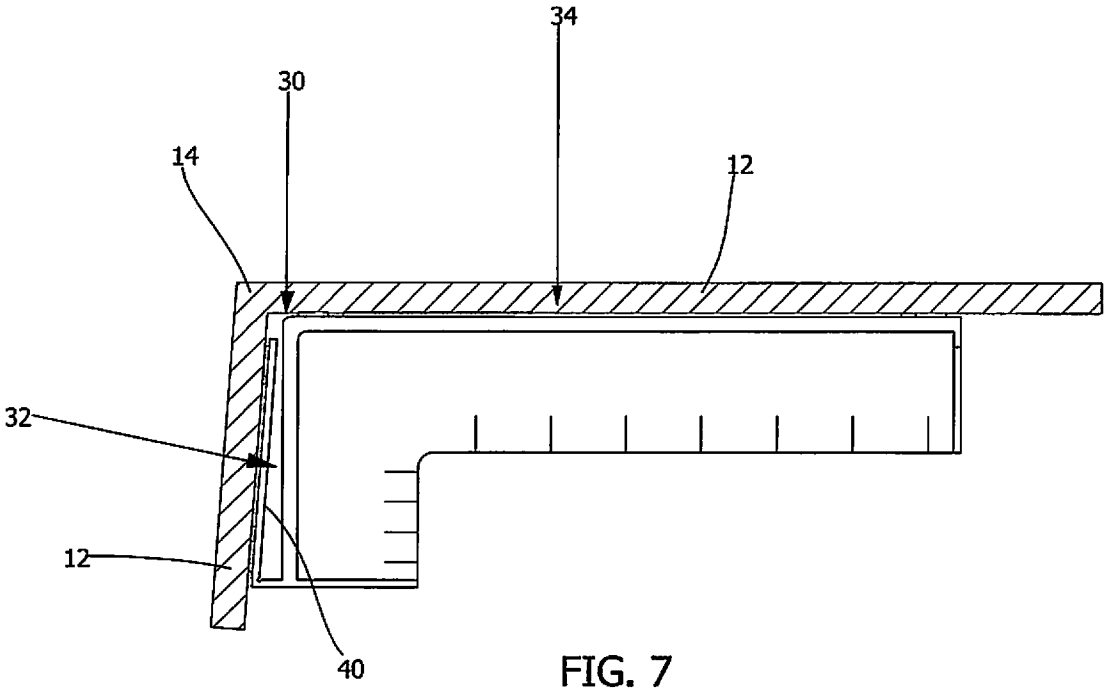
FIG. 7 is a top in-use view of an embodiment of the disclosure.
Figure 8:
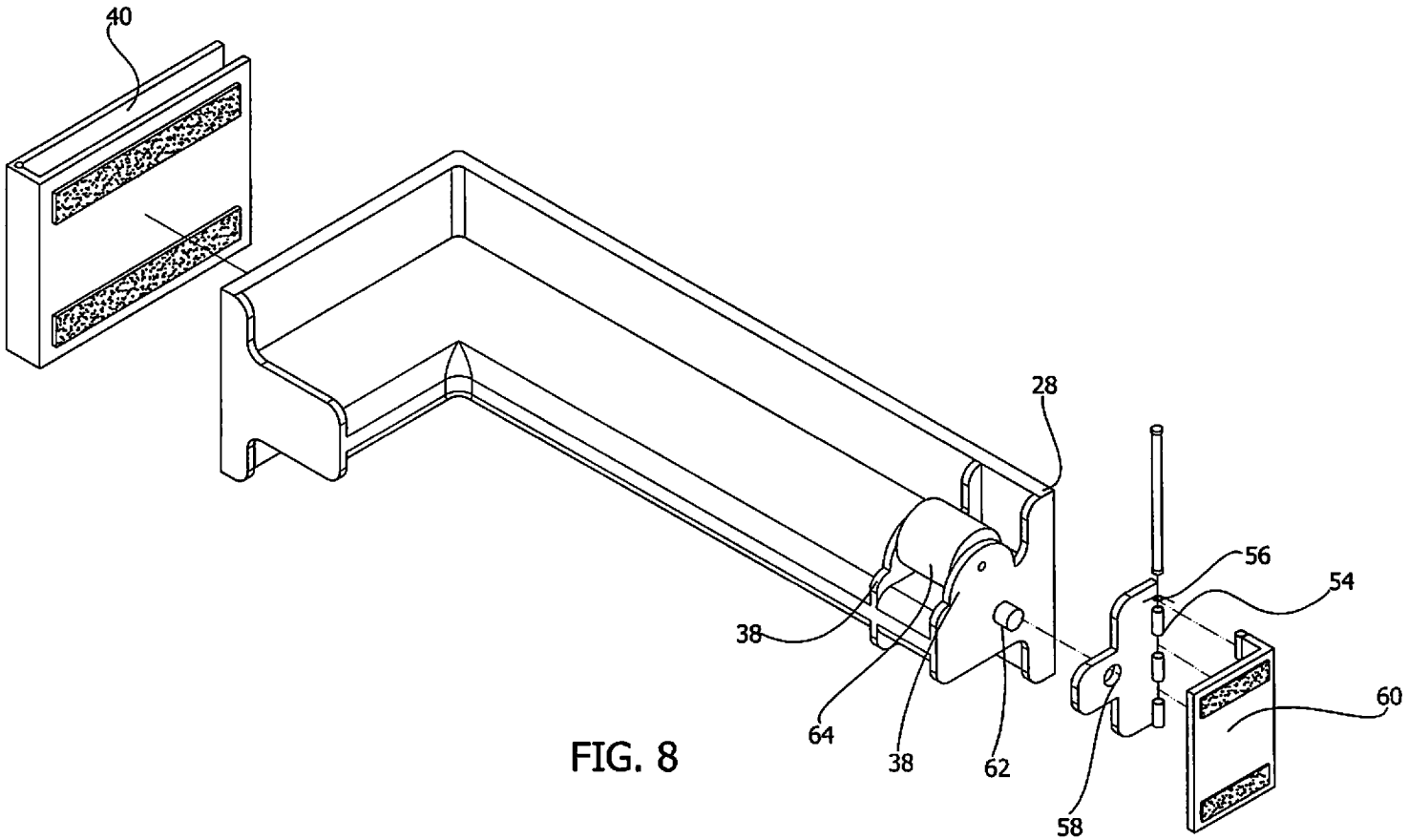
FIG. 8 is an exploded isometric view of an alternative embodiment of the disclosure.
Figure 9:
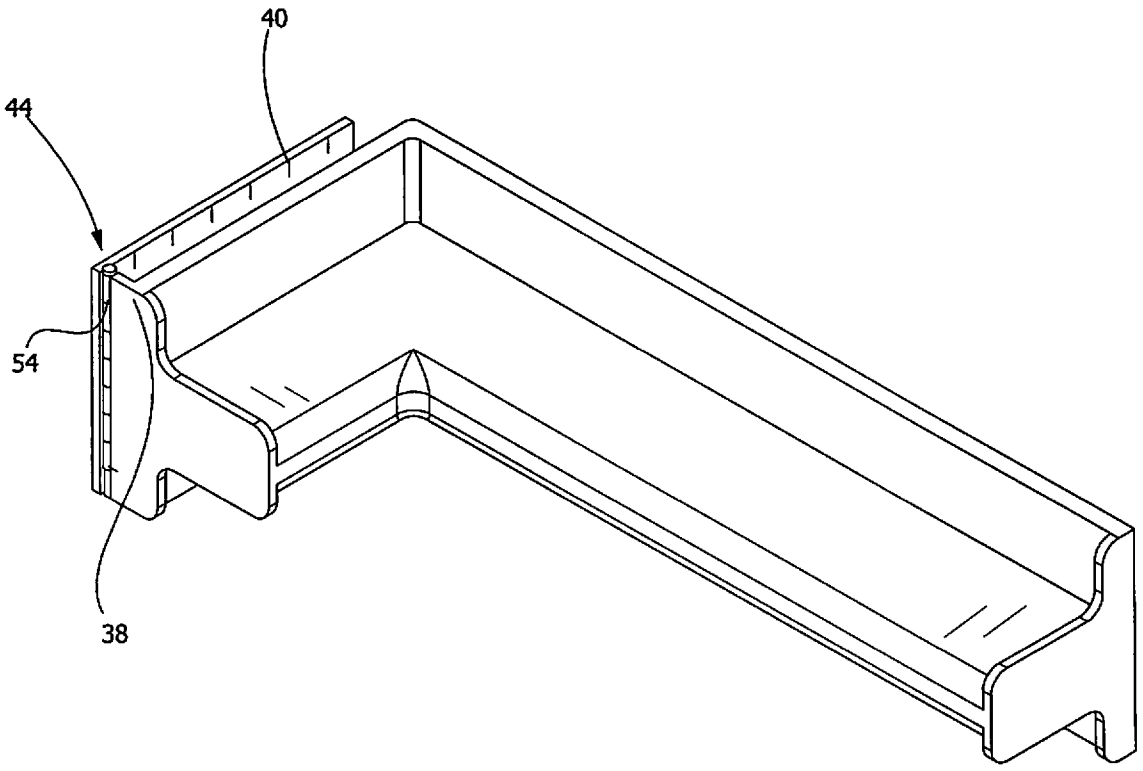
FIG. 9 is an isometric view of an alternative embodiment of the disclosure.
Figure 10:
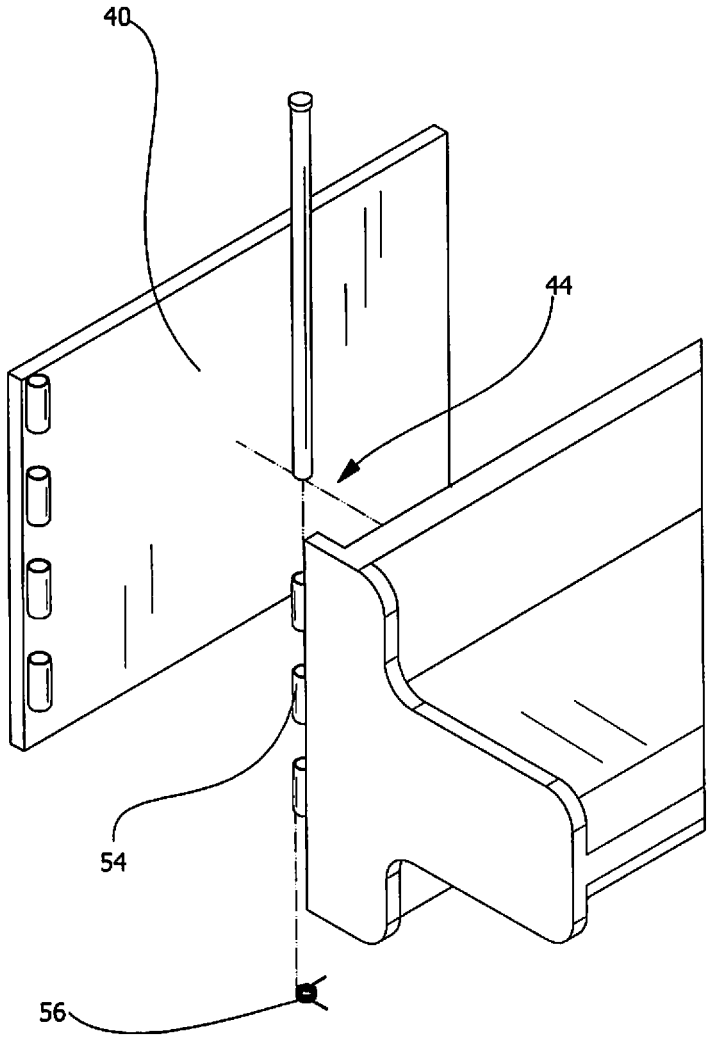
FIG. 10 is an exploded detail view of an alternative embodiment of the disclosure.

With reference now to the drawings, and in particular to FIGS. 1 through 10 thereof, a new corner shelf embodying the principles and concepts of an embodiment of the disclosure and generally designated by the reference numeral 10 will be described.

As best illustrated in FIGS. 1 through 10, the corner shelf securement system 10 generally comprises a pair of walls 12 joined together to define a corner 14 between the pair of walls 12. The corner 14 is a right angle. The corner 14 may also be an obtuse angle or an acute angle. A board 16 has a front surface 18, a back surface 20, a top edge 22, a bottom edge 24, a first side edge 26, and a second side edge 28. The board 16 is elongated from the first side edge 26 to the second side edge 28. The board 16 has a bend 30 defining a first section 32 being perpendicular to a second section 34 such that the board 16 is L-shaped. A length of the first section 32 measuring from the first side edge 26 to the bend 30 is between 10 inches to 12 inches. A distance of the second section measuring from the bend 30 to the second side edge 28 is between 20 inches to 23 inches. A height measuring from the top edge 22 to the bottom edge 24 is between 5 inches to 7 inches.

A shelf 36 is coupled to the board 16. The shelf 36 is L-shaped corresponding to the L-shaped board 16. The shelf 36 is coextensive with the board 16 and extends perpendicularly from the board 16. The shelf 36 is centrally positioned between the top edge 22 of the board 16 and the bottom edge 24 of the board 16. A plurality of braces 38 is coupled to the board 16 and to the shelf 36. The plurality of braces 38 support the shelf 36 in a perpendicular position relative to the board 16. The first 26 and second 28 side edges has one of the braces 38 extending outwardly therefrom and onto the shelf 36. The board 16 may include another brace extending outwardly onto the shelf 36 proximate to the first side edge 26.

A back panel 40 is attached to the first side edge 26 and extends along the back surface 20 of the first section 32 towards the bend 30. The back panel 40 is bendable such that a free end 42 of the back panel 40 is movable inwardly towards the back surface 20 of the first section 32, wherein the back panel 40 is angled inwardly from the first side edge 26 to the bend 30. A juncture 44 joining the back panel 40 with the first side edge 26 has a cutout 46 extending therethrough, wherein the cutout 46 allows the back panel to move inwardly towards the back surface 20 of the first section 32. A fastener 48 is mounted on the board 16 and is engageable to the pair of walls 12 such that the bend 30 is positioned within the corner 14. The fastener 48 comprises a plurality of adhesive strips 50 attached to the back surface 20 of the second section 34 and to the back panel 40 of the first section 32. Each of the adhesive strips 50 is a pressure sensitive adhesive such that the board 16 is pressed against the pair of walls 12 to fasten the board 16 to the walls 12. Each cover panel 52 of a plurality of cover panels 52 is removably engaged to an associated one of the adhesive strips 50 to protect the associated adhesive strip 46 until the cover panel is removed to expose the adhesive strip.

In another embodiment, the back panel 40 is removably fastened to the back surface 20 of the first section 32 of the board 16. The back panel 40 may be fastened to the back surface 20 of the first 32 or second 34 sections to facilitate fastening the board 16 to a pair of walls 12 having a corner 14 be greater than 90-degrees. The back panel 40 may attach to the first side edge 26 by a hinge 54 having a torsion spring 56, wherein the torsion spring 56 is configured to push the back panel 40 outwardly away from the first section 32. Alternatively, a coupling member 58 of a side panel 60 having the hinge 54 with the torsion spring 56 may attach to a pivoting member 62 positioned on the second side edge 28, such that the side panel 60 may pivot upon the second side edge 28 to align the board 16 an uneven angle of one of the pair of walls 12. Furthermore, a toilet paper roller 64 may be coupled to the board 16. The toilet paper roller 64 has a pair of opposite ends engageable to an adjacently positioned pair of the braces 38 such that the toilet paper roller 64 is configured to hold a roll of toilet paper between the adjacently positioned pair of the braces 38.

In use, the back surface 20 of the second section 34 and the back panel 40 each are fastened to a respective one of the pair of walls 12 such that the bed of the board 16 is positioned within the corner 14 of the walls 12. The back panel 40 may bend inwardly to fasten to the walls 12 when the corner 14 is greater than 90-degrees. The board 16 may be positioned within a storage cabinet beneath a sink such that the shelf 36 may hold sink related articles such as cleaning solutions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A corner shelf attachment system comprising:

a pair of walls, said pair of walls being joined together to define a coater between the pair of walls;

a board, said board having a front surface, a back surface, a top edge a bottom edge, a first side edge, and a second side edge, said board having a bend defining a first section being perpendicular to a second section such that said board is L-shaped;

a shelf being coupled to said board;

a plurality of braces being coupled to said board and to said shelf, said plurality of braces supporting said shelf in a perpendicular position relative to said board;

a back panel being attached to said first side edge and extending along said back surface of said first section towards said bend, said back panel being bendable such that a free end of said back panel is movable inwardly towards said back surface of said first section, wherein said back panel is angled inwardly from said first side edge to said bend; and a fastener being mounted on said board, said fastener being engageable to said pair of walls such that said bend is positioned within said corner.

2. The corner shelf attachment, system of claim 1, wherein said corner is a right angle.

3. The corner shelf attachment system of claim 1, wherein said board is elongated from said first side edge to said second side edge.

4. The corner shelf attachment system of claim 1, wherein said shelf is L-shaped, said shelf being coextensive with said board, said shelf extending perpendicularly from said board, said shelf being centrally positioned between said top edge of said board and said bottom edge of said board.

5. The corner shelf attachment system of claim 1, wherein said first and second side edges have one of said braces extending outwardly therefrom and onto said shelf.

6. The corner shelf attachment system of claim 1, wherein said fastener comprises a plurality of adhesive strips attached to said back surface of said second section and to said back panel, each of said adhesive strips being a pressure sensitive adhesive.

7. The corner shelf attachment system of claim 6, further including a plurality of cover panels, each cover panel being removably engaged to an associated one of said adhesive strips to protect said associated adhesive strip until said cover panel is removed to expose said adhesive strip.

8. The corner shelf attachment system of claim 1, further including a toilet paper roller being coupled to said board, said toilet paper roller having a pair of opposite ends engageable to an adjacently positioned pair of said plurality of braces such that the toilet paper roller is configured to hold a roll of toilet paper between the adjacently positioned pair of said plurality of braces.

9. A corner shelf attachment systems comprising:

a pair of walls, said pair of walls being joined together to define a corner between the pair of walls, said corner being a right angle;

a board, said board having a front surface, a back surface, a top edge, a bottom edge, a first side edge, and a second side edge, said board being elongated from said first side edge to said second side edge, said board having a bend defining a first section being perpendicular to a second section such that said board is L-shaped;

a shelf being coupled to said board, said shelf being L-shaped, said shelf being coextensive with said board, said shelf extending perpendicularly from said board, said shelf being centrally positioned between said top edge of said board and said bottom edge of said board;

a plurality of braces being coupled to said board and to said shelf, said plurality of braces supporting said shelf in a perpendicular position relative to said board, said first and second side edges having one of said braces extending outwardly therefrom and onto said shelf;

a back panel being attached to said first side edge and extending along said back surface of said first section towards said bend, said back panel being bendable such that a free end of said back panel is movable inwardly towards said back surface of said first section, wherein said back panel is angled inwardly from said first side edge to said bend;

a fastener being mounted on said board, said fastener being engageable to said pair of walls such that said bend is positioned within said corner, said fastener comprising a plurality of adhesive strips attached to said back surface of said second section and to said back panel, each of said adhesive strips being a pressure sensitive adhesive;

a plurality of cover panels, each cover panel being removably engaged to an associated one of said adhesive strips to protect said associated adhesive strip until said cover panel is removed to expose said adhesive strip; and a toilet paper roller being coupled to said board, said toilet paper roller having a pair of opposite ends engageable to an adjacently positioned pair of said braces such that the toilet paper roller is configured to hold a roll of toilet paper between the adjacently positioned pair of the braces.

* * * * *